United States Patent [19]

Stäbler et al.

[11] Patent Number: 4,727,682

[45] Date of Patent: Mar. 1, 1988

[54] ECCENTRIC GRINDER WITH A DEVICE FOR CHANGING A GRINDING MOTION

[75] Inventors: Manfred Stäbler; Walter Barth, both of Leinfelden-Echterdingen, Fed. Rep. of Germany

[73] Assignee: Robert Bosch GmbH, STuttgart, Fed. Rep. of Germany

[21] Appl. No.: 921,776

[22] Filed: Oct. 21, 1986

[30] Foreign Application Priority Data

Jan. 29, 1986 [DE] Fed. Rep. of Germany ..... 3602571

[51] Int. Cl.[4] ..... B24B 7/00; B24B 23/03

[52] U.S. Cl. ..... 51/120; 51/170 MT

[58] Field of Search ..... 51/119, 170 MT, 120, 51/170 TL, 90

[56] References Cited

U.S. PATENT DOCUMENTS 4,516,358 5/1985 Marton et al. ..... 51/170 MT

FOREIGN PATENT DOCUMENTS 54-54035 11/1980 Japan ..... 51/170 MT

*Primary Examiner*—Frederick R. Schmidt
*Assistant Examiner*—Blynn Shideler
*Attorney, Agent, or Firm*—Michael J. Striker

[57] ABSTRACT

An eccentric grinder is provided with a device for changing a grinding motion. The grinder includes a grinding disc eccentrically positioned on a driving shaft and supporting an internal and an external toothed crowns which are brought to a rolling motion on respective external and internal toothed crowns supported on the housing of the grinder. The toothed crowns supported on the housing are axially displaceable by a handle provided externally of the housing. Three various grinding motions for coarse, medium and fine grinding can be obtained by the drive of the grinder.

12 Claims, 4 Drawing Figures

ECCENTRIC GRINDER WITH A DEVICE FOR CHANGING A GRINDING MOTION

BACKGROUND OF THE INVENTION

The present invention relates to an eccentric grinder.

Eccentric grinders of the type under consideration include a grinding disc eccentrically positioned relative to a driving shaft of the motor of the grinder. Such eccentric grinders have been commercially available and have been disclosed for example in "Fachberichte für-Metallbearbeitung", Apr. 3, 1983, title "Rotex", "Die neue Dimension des Schleifens". In these otherwise satisfactory eccentric grinders an optional adjustment of such a grinder to practical demands has not been, however possible. The gap between the pure coarse grinding and the fine grinding is too large. It has been suggested to avoid this problem to provide the grinder with further drive stages with different diameters of friction or toothed wheels, this however has been possible only with considerable enlargement of the drive structural componenents of the eccentric grinder.

SUMMARY OF THE INVENTION

It is an object of the present invention to provide an improved eccentric grinder.

It is a further object of the invention to provide an eccentric grinder which is extremely compact and simple.

Yet another object of the invention is to provide an eccentric grinder with an optimal output.

These and other objects of the invention are attained by an eccentric grinder comprising a housing; a driving shaft; a grinding disc positioned in said housing eccentrically relative to said shaft; a pure eccentric drive for driving said disc from said shaft; and a device for changing a grinding movement of said grinding disc, said device including drive means for said grinding disc, said drive means including a first crown means positioned rotationally on said driving shaft and eccentrically relative to said driving shaft and a second crown means engageable with said first crown means for forcible rolling movement thereon and positioned in said housing concentrically with said driving shaft, the improvement comprising said grinding disc supporting said first crown means which include an internal crown and an external crown, said housing supporting said second crown means which include an internal crown engageable with said external crown of said first crown means and an external crown engageable with said internal crown of said first crown means, said second crown means being adjustable on said housing along an axis of said driving shaft so as to interchange between establishing a drive connection between said first and second crown means and releasing said drive connection.

The first and second crown means may include friction crown means.

The first and second crown means may be formed as toothed crowns, said internal crown being an internal toothed crown and said external crown being an external toothed crown.

The housing may have a bell-shaped portion which overlaps an inner surface of said grinding disc with said first crown means supported thereon and receives said second crown means supported on said housing; the device may further include adjustment means also received in said bell-shaped portion.

The diameter of said external crown of said first crown means may be smaller than the diameter of said internal crown of said first crown means and the difference between said diameters corresponds to a difference between the diameters of said external toothed crown and internal toothed crown of said second crown means plus an eccentricity X between said driving shaft and said grinding disc. Such an embodiment offers a possibility of specifically favorable arrangement in which the contact positions for the both forced drive connections can be offset by 180°.

The grinder may further include a carrier for supporting two toothed crowns of said second crown means on said housing, the two toothed crowns of said first crown means being secured on said grinding disc, said two toothed crowns on said carrier and said two toothed crowns on said grinding disc being axially displaceable relative to each other.

An axial distance between said internal crown and external crown of said first crown means may be greater than the width of said internal and external toothed crown of said second crown means.

The carrier may be a sleeve concentrically surrounding said driving shaft, said sleeve having a flange extending toward said grinding disc and having an outer rim formed with an external toothing and an inner rim formed with an internal toothing; the device may further include a ring rigidly connected to said housing and guiding said sleeve, said ring having at least one slot extending in the direction of helical line; at least one pin engaged in said slot, said pin being secured to said sleeve; and a handle, said pin extending outwardly from said bell and carrying said handle.

Said pin may have a thread and said handle has a nut engaged on said thread, and by which tightening of a selection device can be secured.

In another embodiment the grinder may include two axially displaceable carrier sleeves adjustable relative to each other and forming said second crown means, and guide means including at least one pin, two oppositely inclined slots provided in said internal toothed crown and said external toothed crown, respectively, of said second crown means and one straight guide slot formed in said housing, said pin extending through said slots and being axially movable in said slots by an externally applied force to axially displace said sleeves with said second crown means, said first crown means being formed of one piece and terminating in one plane whereby engaging surfaces of said second crown means can roll over engaging surfaces of said first crown means.

Due to the change from one drive of the grinding disc to another drive, namely to the toothed crown means provided on the housing and the grinding disc, respectively and performing a rolling motion of the toothed crowns relative to each other, an eccentric movement of the oppositely-directed grinding motion changes over into the eccentric grinding movement in the same direction. This means that the path of the abrasive grains per rotation of the eccentric in accordance with this change is the greatest and thereby the material removal is also the greatest. Therefore dimensions of the friction-or-toothed crowns should be changed only insignificantly. The friction-or-toothed crowns can be arranged tightly close to each other and can be easily brought in alternating fashion to a rolling engagement in the housing of the grinder. A third grinding motion which produces the finest grinding is obtained by an intermediate position in which the eccentric is not forcibly rolled. The grinding motion produced by the eccentric follows a cycloid with superposed rotation movement depending on counterpressure. The path of individual abrasive grains per rotation of the eccentric is here the smallest.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
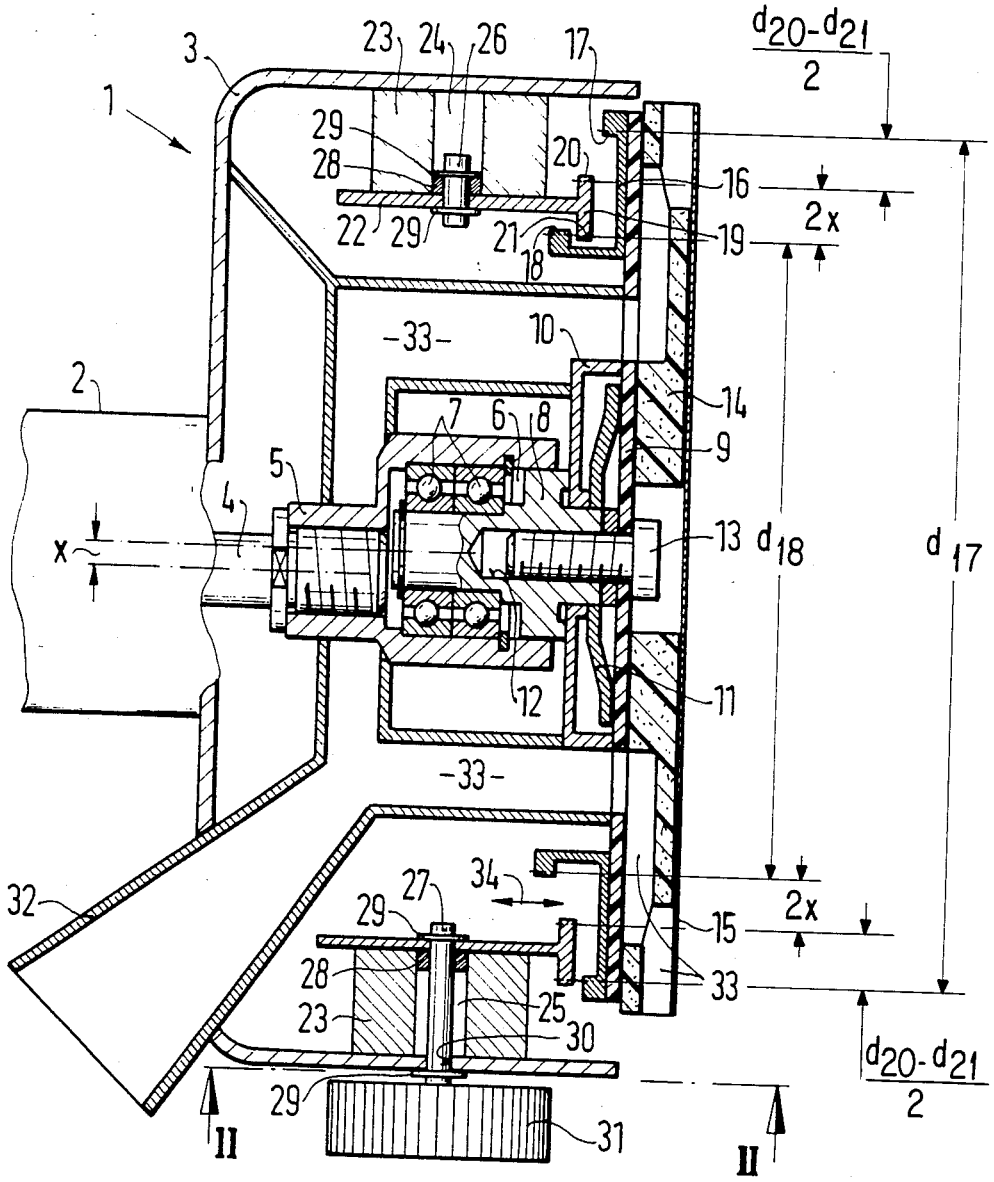
FIG. 1 is an axial sectional view of the eccentric grinder in the region of the drive and grinding disc, according to a first embodiment of the invention.
Figure 2:
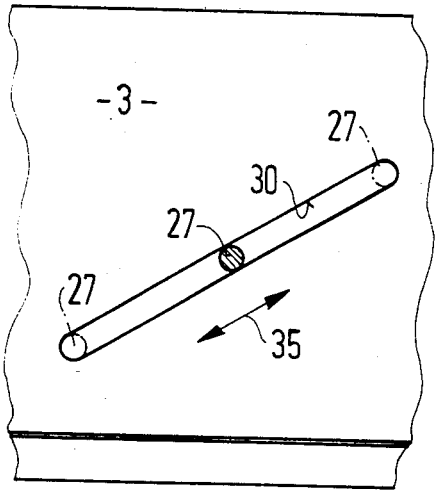
FIG. 2 is a sectional view taken on line II—II of FIG. 1.

Referring firstly to FIGS. 1 and 2 of the drawings, an eccentric grinder 1 of this invention includes a housing 2 a part of which forms a bell 3. A motor is accommodated in the housing 2, of which motor only a driving shaft 4 is shown. The driving shaft extends into the interior of bell 3 and carries thereon an intermediate element 5 which is formed as a crank and has a cylindrical recess 6 which is eccentric to the axis of the driving shaft 4. The eccentricity which is defined by the distance between the axis of shaft 4 and the central axis of recess 6 is designated by reference character X.

Two ball bearings 7, adjacent to each other, are inserted in the recess 6. These ball bearings receive a supporting journal 8 for a grinding disc 9. A cup-shaped rotation member 10, a disc-shaped spring 11 and a bolt 13 screwed into a threaded bore 12 in the supporting journal 8 serve to fasten the grinding disc 9 to the supporting journal 8. A soft-elastic layer 14 is glued to the end face of the grinding disc 9. This layer or coating serves to receive a specific grinding sheet or plate. The grinding disc 9 supports at its inner surface a double toothed crown 16 which is concentric with the axis of elongation of the supporting journal 8 and therefore is eccentric to the driving shaft 4. The double toothed crown 16 has an internal toothed crown 17 and an external toothed crown 18. Both toothed crowns 17 and 18 are axially offset relative to each other so that a space or gap remains between these crowns in the axial direction. A double toothed crown 19 having also an external toothed crown 20 and an internal toothed crown 21 is inserted in said space. The double toothed crown 19 is formed as an end flange of a sleeve 22 which concentrically surrounds the driving shaft 4. Sleeve 22 is guided in a ring 23 which is rigidly fixed to the housing. Ring 23 has two slots 24 and 25 which extend along a helical line. Pins 26 and 27 extend in these slots. Pins 26 and 27 are secured in the bores of the sleeve 22 and each supports a slide ring 28. Slide rings 28 are both secured by safety washers 29. While the pin 26 ends in the slot 24 the other pin 27 extends through the whole slot 25 and projects outwardly therefrom through a further slot 30 provided in the bell 3. The outer end of pin 27 projecting from the bell 3 is provided with a thread on which a knurled nut 31, formed as a handle is screwed.

Reference numeral 32 denotes a connection, by means of which a suction passage 33, provided inside the bell 3, can be connected to a dust suction device.

A double arrow 34 in FIG. 1 illustrates the directions of the axial displacement of the sleeve 22 within the bell 3. A double arrow 35 in FIG. 2 shows the directions of an adjustment movement which can be carried out with the aid of the knurled nut 31 to readjust the grinding movements.

In the position of sleeve 22 shown in FIG. 1 there is no driving connection between the double toothed crowns 16 and 19. The drive of the grinding disc 9 takes place therefore not forcibly for a predetermined grinding movement but via the intermediate element 5 with the eccentric recess 6. The supporting of the journal 8 in the ball bearings 7 in this recess 6 indicates that the grinding disc 9 is freely rotatable about the axis of the supporting journal 8. Therefore during the grinding the grinding disc 9 performs the movement which follows a cycloidal path with the superposing rotational movement whereby the superposition of the rotational movement is dependent upon a counter pressure during the grinding process. The path of each individual abrasive grain per an eccentric rotation is very small so that a very fein grinding finish will be obtained and thus a material removal will be small. This grinding movement is specifically suitable for grinding progressive transition zones.

If sleeve 22 is shifted by means of the knurled nut or handle 31 to the right, according to FIG. 2,to its end position as shown in that figure, the external toothed crown 20 comes into mesh with the internal toothed crown 17. Inasmuch as during the grinding process the sleeve 22 is fixed with its double toothed crown 19 the internal toothed crown 17 rolls on the external toothed crown 20. Each abrasive grain of the grinding or abrasive sheet 15 secured to the grinding disc 9 describes, during the grinding with this adjustment, a pericycloid at which the rotational movement will coincide with the direction of rotation of the eccentric. Thereby the path of abrasive grains per one rotation of the eccentric is the largest. This grinding movement causes the greatest material removal and is therefore suitable for a coarse grinding but unsuitable for grinding fine transition zones.

If the sleeve 22 is moved by the nut 31 to its opposite end position the inner toothed crown 21 of the double toothed crown 19 comes into engagement with the outer toothed crown 18 of the double toothed crown 16. Since, upon grinding, the internal toothed crown 21 remains stationary the external toothed crown 18 rolls on the toothed crown 21 and thus defines the grinding movement of the grinding disc 9. Each abrasive grain of the abrasive sheet 15 describes an extended hypocycloid whereby it moves counter to the direction of rotation of the eccentric. This causes a greater material removal than that produced during the firstly mentioned grinding process without a forced rolling motion but a smaller material removal that that occuring during the previously described grinding motion. Accordingly a finer grinding finish is produced. With such an adjustment, transition surfaces can be also ground. It is however expedient for a fine grinding that the driving connection between the double toothed crowns 16 and 19 be released. Each of the three possible above-described adjustments of the sleeve 22 can be secured because the nut 31 can be pulled against its adjacent safety washer 29 which has a sufficient longitudinal play relative to the pin 27 to ensure clamping on the bell 3.

Figure 4:
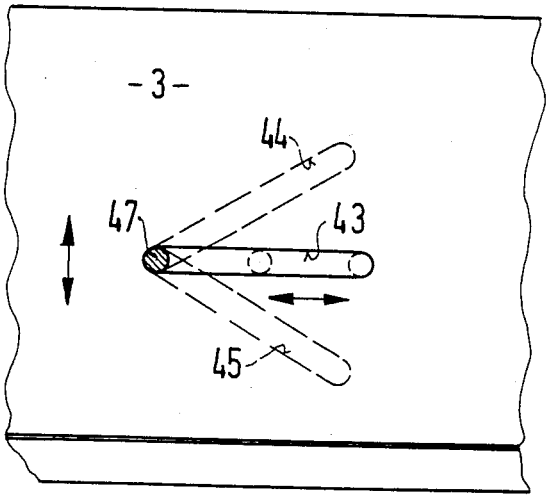
FIG. 4 is a sectional view taken on line IV—IV of FIG. 3.
Figure 3:
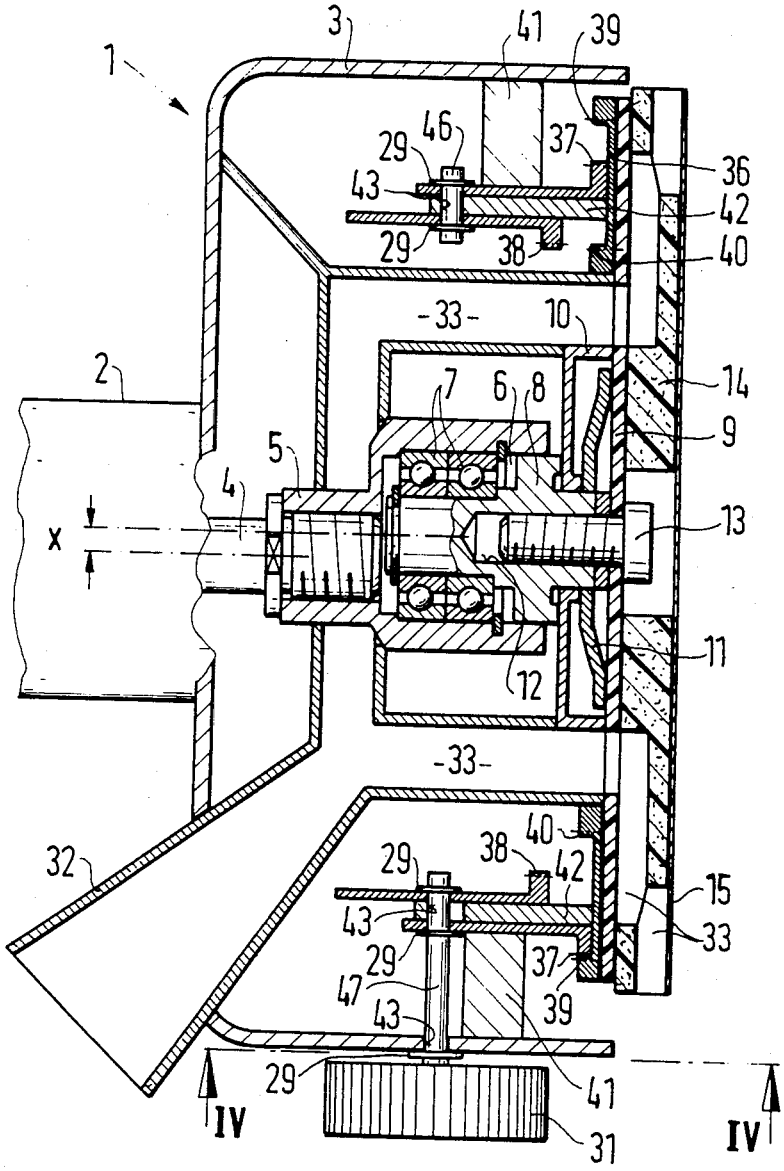
FIG. 3 is an axial sectional view of another embodiment of the eccentric grinder.

In the embodiment illustrated in FIGS. 3 and 4, a double toothed crown 36 in place of the double toothed crown 16, and two separate toothed crowns, namely an external toothed crown 37 and an internal toothed crown 38, in place of the double toothed crown 19 of FIG. 1, are utilized. The double toothed crown 36 includes an internal toothed crown 39 and an external toothed crown 40 terminating in the same plane. A ring 41 inserted in the bell 3 serves to guide the external toothed crown 37 which is directly supported by the ring 41. Between the external toothed crown 37 and the internal tooth crown 38 is positioned an intermediate sleeve 42. This intermediate sleeve serves as a guide for the internal toothed crown 38. The intermediate sleeve 42 and the bell 3 have respectively slots 43 extends in the peripheral direction. The external toothed crown 37 and the internal toothed crown 38 have two slots 44 and 45 provided with opposite ascents. A pin 46 which is diametrically opposite to the knurled nut 31 extends through the slot 43 in the intermediate sleeve 42 and also slots 44 and 45 in the toothed crown 37 and toothed crown 38. Thereby pin 46 is secured against axial displacement by the safety washer 29. Pin 47 extends near slot 43 in the intermediate sleeve 42 and penetrates slots 44 and 45 and eventually slot 43 in the bell 3. Pin 47 similarly to the pin 27 is provided, at its end outwardly extended from the bell 3, with the spiral thread and carries thereon the knurled nut or handle 31.

In the position shown in FIG. 3, the external toothed crown 37 is in engagement with the internal toothed crown 39. Thereby the driving connection, described as the first adjustment for the coarse grinding in connection with FIG. 1, is established. If the pin 47 is in its middle position the driving connection between the external toothed crown and the internal toothed crown becomes discontinued. Thus the adjustment for fine grinding is obtained as has been explained above for the embodiment of FIGS. 1 and 2. If the structural components of the grinder are moved with the aid of handle 31 to the other end position the internal toothed crown 38 comes into engagement with the external toothed crown 40. Thus the driving connection is established for a medium grinding. It appears to be clear that the external toothed crown 37 and internal toothed crown 38 perform, during the adjustment by the knurled nut 31, axial motions in opposite directions. The grinding output for the embodiment of FIGS. 3 and 4 is the same as that for the embodiment of FIGS. 1 and 2.

It will be understood that each of the elements described above, or two or more togehter, may also find a useful application in other types of eccentric grinders differing from the types described above.

While the invention has been illustrated and described as embodied in an eccentric grinder with a device for changing grinding motions, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an eccentric grinder comprising a housing; a driving shaft having an axis; a grinding disc positioned in said housing eccentrically relative to said shaft; a pure eccentric drive for driving said disc from said shaft; and a device for changing a grinding movement of said grinding disc, said device including drive means for said grinding disc, said drive menas including a first crown means positioned rotationally on said driving shaft and eccentrically relative to said driving shaft, and a second crown means engageable with said first crown means for forcible rolling movement thereon and positioned in said housing concentrically with said driving shaft, the improvement comprising said grinding disc supporting said first crown means which include an internal crown (17/39) and an external crown (18/40), said housing supporting said second crown means (20/21, 37/38) which include an internal crown (21/38) engageable with said external crown (20/37) engageable with said internal crown (17/39) of said first crown means, said internal crown and external crown of said first crown means being offset relative to each other along the axis of said driving shaft, and said internal crown and external crown of said second crown means being displaceable along the axis of said drive shaft so as to establish or release a drive connection between said first and second crown means.

2. The grinder as defined in claim 1, wherein said frist and second crown means include gear wheel crown means.

3. The grinder as defined in claim 1, wherein said first and second means are formed as toothed crowns, said internal crown of each crown means being an internal toothed crown and said external crown of each crown means being an external toothed crown.

4. The grinder as defined in claim 3, wherein said housing has a bell which overlaps an inner surface of said grinding disc with said first crown means supported thereon and receives said second crown means supported on said housing; and further including means (26, 27, 31) for displacing said second crown means along the axis of said drive shaft also received in said bell.

5. The grinder as defined in claim 3, said grinding disc having a central axis and wherein the diameter of said external toothed crown (18, 40) of said first crown means as measured relative to said central axis is smaller than the diameter of said internal crown (17/39) of said first crown means, and the difference betwen said diameters amounts to a difference between diameters of said external toothed crown (20/37) and internal toothed crown (21/38) of said second crown means plus a fourfold eccentricity X between said driving shaft and said grinding disc.

6. The grinder as defined in claim 5, further including two carrier sleeves, and means for displacing said sleeves so that they are adjustable relative to each other, said sleeves forming said second crown means (37/38), and guide means including at least one pin (47), two oppositely inclined slots (44,45) provided in said internal toothed crown and said external toothed crown, respectively, of said second crown means, and one straight guide slot (43) formed in said housing, said pin extending through said slots and being radially movable in said slots by an externally applied force to axially displace said sleeve with said second crown means, said first crown means being formed of one piece and terminating in one plane whereby engaging surfaces of said second crown means can roll over engaging surfaces of said first crown means.

7. The grinder as defined in claim 3, further including a carrier (22) for supporting said internal and external toothed crowns of said second crown means on said housing, said internal and external toothed crowns of said first crown means being secured on said grinding disc, said internal and external toothed crowns on said carrier being spaced from said internal and external toothed crowns on said grinding disc in the direction of the axis of said shaft.

8. The grinder as defined in claim 7, wherein said carrier is a sleeve (22) concentrically surrounding said driving shaft, said sleeve having a flange (19) extending toward said grinding disc and having an outer rim formed with an external toothing (20) of said second crown means and an inner rim formed with an internal toothing (21) of said second crown means; and further including a ring (23) rigidly connected to said housing and guiding said sleeve, said ring having at least one helical slot (24, 25); at least one pin (26, 27) engaged in said slot, said pin being secured to said sleeve; and a handle (31), said pin extending outwardly from said bell and carrying said handle.

9. The grinder as defined in claim 6, wherein said pin has a thread and said handle has a nut engaged on said thread, and by which tightening of said pin can be secured.

10. The grinder as defined in claim 7, wherein an axial distance betwen said internal crown and said external crown of said first crown means (17/18) is greater than the width of said internal and external toothed crown of said second crown means.

11. In an eccentric grinder comprising a housing; a driving shaft having an axis; a grinding disc positioned in said housing eccentrically relative to said shaft; a pure eccentric drive for driving said disc from said shaft; and a device for changing a grinding movement of said grinding disc, said device including drive means for said grinding disc, said drive means including a first crown means positioned rotationally on said driving shaft and eccentrically relative to said driving shaft, and a second crown means engageable with said first crown means for forcible rolling movement thereon and positioned in said housing concentrically with said driving shaft, the improvement comprising said grinding disc supporting said first crown means which include an internal crown (17/39) and an external crown (18/40), said housing supporting said second crown means (20/21, 37/38) which include an internal crown (21/38) engageable with said external crown (18,40) of said first crown means and with said external crown (20/37) engageable with said internal crown (17/39) of said first crown means being offset relative to each other along the axis of said drive shaft; and means for displacing said internal crown and external crown of said second crown means along the axis of said drive shaft, so as to establish or release a drive connection between said first and second crown means.

12. In an eccentric grinder comprising a housing; a driving shaft having an axis; a grinding disc positioned in said housing eccentrically relative to said shaft; a pure eccentric drive for driving said disc from said shaft; and a device for changing a grinding movement of said grinding disc, said device including drive means for said grinding disc, said drive means including a first crown means positioned rotationally on said driving shaft and eccentrically relative to said driving shaft, and a second crown means engageable with said first crown means for forcible rolling movement thereon and positioned in said housing concentrically with said driving shaft, the improvement comprising said grinding disc supporting said first crown means which include an internal crown (17/39) and an external crown (18/40), said housing supporting said second crown means (20/21, 37/38) which include an internal crown (21/38) engageable with said external crown (18,40) of said first crown means and an external crown (20/37) engagaeable with said internal crown (17/39) of said first crown means, said internal crown and external crown of said first crown means being offset relative to each other along the axis of said drive shaft; and means for displacing said internal crown and external crown of said second crown means along the axis of said drive shaft, so as to establish or release a drive connection between said first and second crown means, said first and second crown means formed as toothed crowns, said internal crown of each crown means being an internal toothed crown and said external crown of each crown means crown being an external toothed means.

* * * * *